United States Patent [19]

Emerson et al.

[11] 4,428,509

[45] Jan. 31, 1984

[54] DISPENSING DEVICE FOR CONTINUOUS AEROSOL

[75] Inventors: Kenneth R. Emerson; Diane Haworth, both of Racine County, Wis.

[73] Assignee: S. C. Johnson & Sons, Inc., Racine, Wis.

[21] Appl. No.: 364,565

[22] Filed: Apr. 1, 1982

[51] Int. Cl.[3] ..... B65D 83/14

[52] U.S. Cl. ..... 222/153; 222/402.14

[58] Field of Search ..... 222/402.14, 182, 402.13, 222/153, 402.11, 402.1, 402.12

[56] References Cited

U.S. PATENT DOCUMENTS

| | | | |
|---|---|---|---|
| 3,185,350 | 5/1965 | Abplanalp et al. | 222/402.14 |
| 3,539,078 | 11/1970 | Venus, Jr. | 222/153 |
| 3,744,682 | 7/1973 | Blank | 222/402.13 |

*Primary Examiner*—Stanley H. Tollberg

[57] ABSTRACT

A dispensing device for continuous aerosol dispensing. The device includes a skirt having a lower edge adapted for attachment to an aerosol container, an actuator button hinged to the skirt and engageable with the valve stem, and a discharge orifice in the button in fluid communication with the valve stem. The skirt extends upwardly to form a wall around the actuator button and to recess the button. Such wall defines a gap for finger access to the button. A removable tab substantially covers the gap, such tab being connected by connectors both to the skirt and the button. The connectors to the button are frangible while the connector or connectors to the skirt may be frangible or may be used as hinges for folding the tab away from the button. The device may be actuated after removal of the tab. Preferred embodiments include a sharp protruding member centrally located on the button to improve the child-safe and tamper-proof characteristics of the device.

7 Claims, 6 Drawing Figures

DISPENSING DEVICE FOR CONTINUOUS AEROSOL

FIELD OF THE INVENTION

This invention relates generally to aerosol dispensing devices and more specifically to devices for continuously dispensing the contents of aerosol containers until exhaustion thereof.

BACKGROUND OF THE INVENTION

In the prior art, a number of devices have been disclosed for continuous dispensing of aerosol products. Such devices are typically attached to an aerosol container at the end from which a depressible valve stem protrudes. A common characteristic of such devices is the means they include to lock the depressible aerosol valve stem in a depressed actuating position.

Locking the aerosol valve stem in an actuating position is accomplished in a number of ways. Many devices of the prior art have required a number of working parts to lock the actuators in actuating position. In some case, a number of steps were necessary to lock the device in actuating position. There has been a need for continuous aerosol dispensing devices which are simple in construction and operation.

Certain devices of the prior art, while easily actuated, may pose a threat to children of tender years. Continuous aerosol dispensing devices are most typically used with insecticide foggers and, thus, inadvertent actuation by a small unattended child poses a danger to the child, particularly since once actuated such devices typically continue operating unless extreme measures are taken. Certain devices of the prior art require separate expensive overcaps to prevent inadvertent actuation by children. Thus, there has been a need for continuous aerosol dispensing devices which are child-safe. In particular, there has been a need for an inexpensive child-safe continuous aerosol actuating device.

The nature of continuous aerosol products also suggests that tamper-proof features are of considerable importance with such products. A need has existed for superior tamper-proof continuous aerosol dispensing devices.

OBJECTS OF THE INVENTION

The principal object of this invention is to provide an improved dispensing device for continuous aerosols.

Another object of this invention is to provide a dispensing device for continuous aerosols overcoming problems of prior continuous aerosol dispensing devices.

Another object of this invention is to provide a continuous aerosol dispensing device which may be easily actuated.

Still another object of this invention is to provide a continuous aerosol dispensing device which does not require a plurality of separate parts and complex actuating motions.

Yet another object of this invention is to provide a continuous aerosol dispensing device with improved child-safe characteristics.

Another object of this invention is to provide a continuous aerosol dispensing device having improved tamper-proof characteristics.

Still another object of this invention is to provide a continuous aerosol dispensing device combining the advantages of simplicity, easy operation, improved child-safe characteristics, and improved tamper-proof characteristics.

These and other objects of the invention will be apparent from the following description of the invention.

BRIEF SUMMARY OF THE INVENTION

This invention is a dispensing device for continuous aerosol dispensing. The dispensing device of this invention includes a skirt having a lower edge adapted for attachment to an aerosol container in a position surrounding the aerosol valve stem, an actuator button hinged to the skirt, extending across and engaging the stem and defining a stem-engaging socket and discharge orifice in fluid communication with the stem. The skirt extends upwardly from a major circumferential portion of its lower edge in a direction parallel to the valve stem. Such upward extension of the skirt provides a recess for the actuator button. The skirt defines a gap for finger access to the button when the dispensing device is prepared for actuation.

A removable tab substantially covers such gap, such tab being connected by connectors to both the skirt and the button. The connectors between the tab and button are frangible while the connectors (one or more) between the tab and skirt may also be frangible or may form hinge means to allow the tab to be pivoted away from the button. The connectors are preferably along the lower edge of the tab. If all such connectors are frangible, the tab can be removed by twisting to break such frangible connectors, thereby freeing the button and exposing the aforementioned gap to an operator's finger to allow depression of the actuator button. Or, the tab may be removed by folding the tab away from the button to break the frangible connectors to the button and make room for finger access to the button.

In preferred embodiments, there are first and second interlocking means on the button and the skirt, respectively, to lock the button in a depressed dispensing position upon depression of the button after removal of the tab. It is preferred that the tab, before removal, also be connected by a connector to the second interlocking means, that is the interlocking means on the skirt.

In a highly preferred embodiment, a substantially sharp member protrudes upwardly from a central location on the button. Such sharp protruding member discourages attempts by children of tender years to depress the button prior to removal of the tab. The tab itself, while easily removable by an adult's twisting, may not be easily removed by a child. The connectors holding the tab in place and locking the button against actuation may be of a sufficient size to provide suitable child-safe characteristics.

The entire dispensing device is preferably an integrally molded, unitary plastic piece. Its construction is thus simple.

The location of the tab and the unbroken connectors serve to prevent actuation of the device prior to removal of the tab. The removable tab also serves as a tamper-proof device. As long as it remains in place, one can be assured that the aerosol device has not been actuated and that the original contents of the container with which the dispensing device is used have not used to any extent.

DETAILED DESCRIPTION OF PREFERRED EMBODIMENTS

FIGS. 1–7 show a preferred dispensing device 10 in accordance with this invention. Dispensing device 10 is adapted for continuous disensing from an aerosol container 12 of the type having an axially located stem (not shown) protruding from its top end 14. Dispensing device 10 is a unitary piece integrally molded of polypropylene or high density polyethylene, or any of a variety of other suitable materials well-known to those skilled in the art. The device has child-safe and tamper-proof qualities which make it highly useful as a one-use actuator for insecticide foggers and the like.

Figure 2:
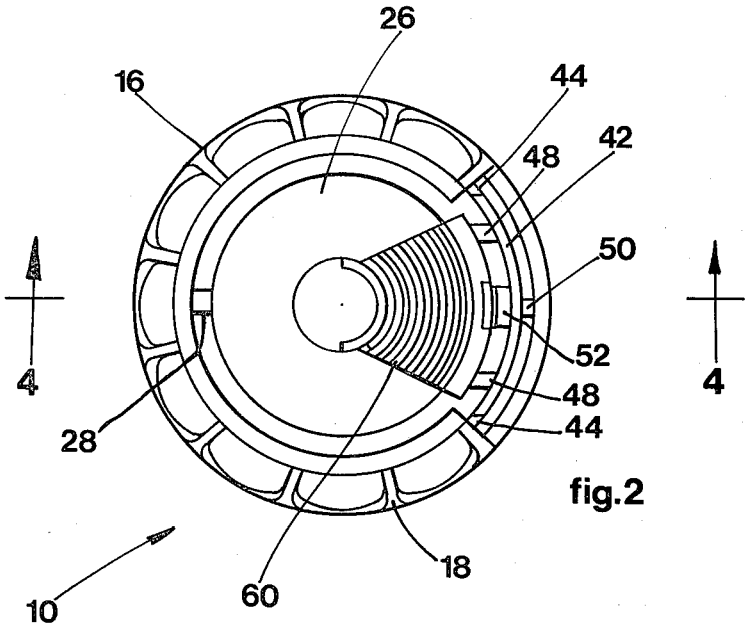
FIG. 2 is a top plan view of the dispensing device of FIG. 1.

Dispensing device 10 includes a generally cylindrical skirt 16 reinforced by vertical ribs 18. Skirt 16 has a lower edge 20 which is adapted for attachment to container 12. Lower edge 20 has an undercut 22 which allows snap-fitting onto the aerosol valve cup bead (not shown) at the top of container dome 24. An actuator button 26, which is generally circular as shown in the top plan view of FIG. 2, is attached to the inside wall of skirt 16 by a hinge 28 approximately midway along the length of skirt 16.

Actuator button 26 extends across the valve stem and defines a stem-engaging socket 30 on its underside. Socket 30 is sized and located to frictionally engage the valve stem of container 12, in well-known fashion. Actuator button 26 also defines a fluid passageway 32 which terminates in an upwardly facing discharge orifice 34. Depression of actuator button 26 depresses the valve stem to cause the flow of fluid from container 12 through passageway 32 and discharge orifice 34.

Along a major circumferential portion thereof skirt 16 extends upwardly above the position of hinge 28 and actuator button 26. Such upward extension 36 provides a recess 38 for actuator button 26. Such upward extension 36 of skirt 16 includes a major circumferential portion of the skirt but is interrupted at a position adjacent to that portion of actuator button 26 which is opposite hinge 28. Thus, skirt 16 defines a gap 40 of sufficient dimension along the circumference of the skirt to provide finger access to a finger press surface 60 of actuator button 26.

Substantially covering gap 40 and generally along the cylinder defined by upward extension 36 of skirt 16 is a removable tab 42. Removable tab 42 is joined to skirt 16 by connectors 44 on opposite sides of the bottom edge 46 of tab 42. Removable tab 42 is joined to actuator button 26 by connectors 48. Connectors 48 are also along bottom edge 46 of tab 42. Connectors 48 could be broken by application of a substantial downward force on actuator button 26, but are of sufficient strength to prevent depression of actuator button 26 by a child of tender years.

Tab 42 may be removed by gripping its opposing flat surfaces between two fingers and bending it outwardly and downwardly about its bottom edge 6 to break connectors 44 and 48 and connector 58 (described hereafter). Removal of tab 42 leaves actuator button 26 free to be depressed and at the same time provides access to finger press surface 60 to actuate the aerosol valve. The removal of tab 42 may require repeated movement or twisting thereof about bottom edge 46 to completely break all frangible connectors. The degree of effort required will be determined by many factors, including the strength and brittleness of the material and the length of the tab. Thus, the product may be designed to meet the intended child-safe and tamper-proof objectives.

After tab 42 is removed and actuator button 26 has been broken free of all breakable connectors, actuator button 26 can be locked in a depressed dispensing position upon full depression of button 26. Interlocking means on button 26 and the lower portion 50 of skirt 16 hold button 26 in the depressed dispensing position. The interlocking means are a downwardly facing locking spur 52 on the inner wall of skirt lower portion 50 and a corresponding upwardly facing ledge 54 on actuator button 26 positioned opposite hinge 28. The portion of button 26 which is adjacent to spur 52 includes a camming surface 56 which flexes spur 52 radially outwardly until it clears camming surface 56 whereupon spur 52 snaps radially inwardly to engage ledge 54 and prevent return upward movement of actuator button 26.

Figure 1:
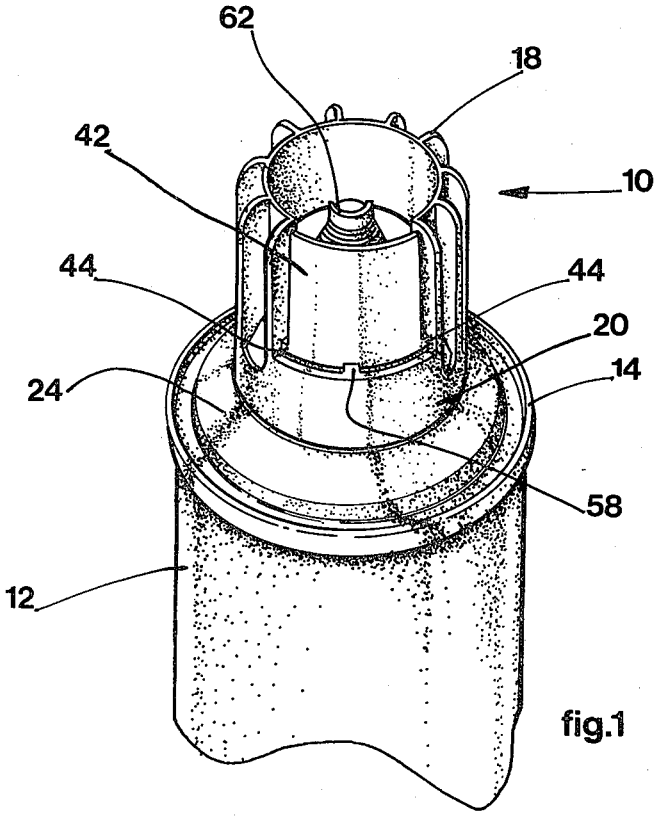
FIG. 1 is a perspective view showing the dispensing device of this invention and a fragmentary portion of an aerosol container on which such device is mounted.
Figure 4:
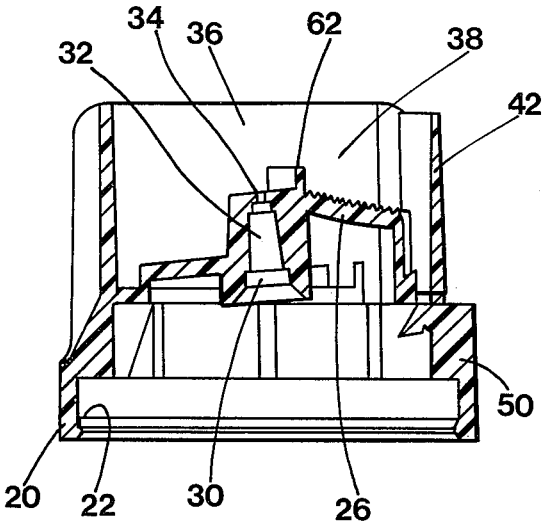
FIG. 4 is a side sectional view taken along section 4—4 as indicated in FIG. 2.
Figure 3:
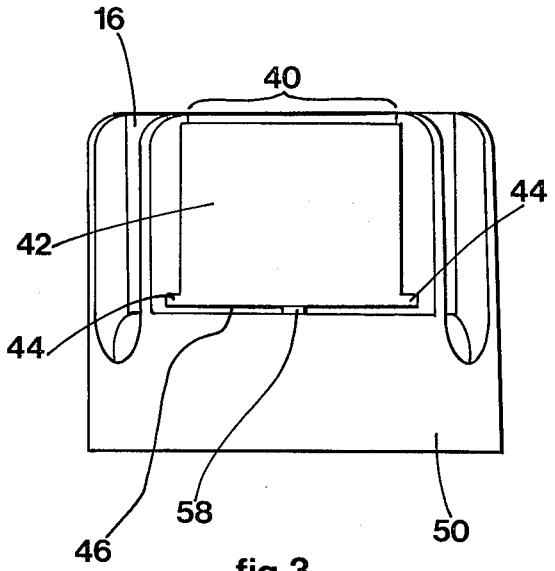
FIG. 3 is a front elevation of the dispensing device of FIG. 1.
Figure 5:
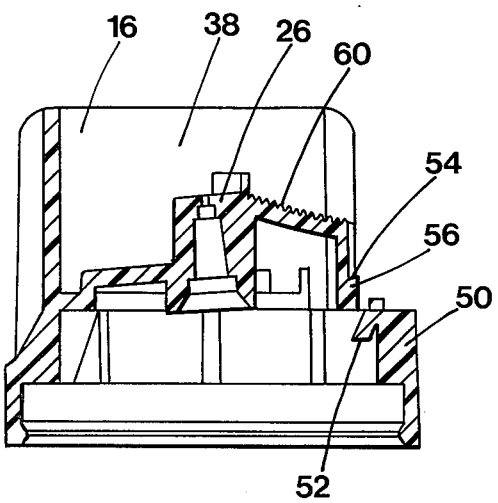
FIG. 5 is a side sectional view as in FIG. 4, but with the tab broken away.
Figure 6:
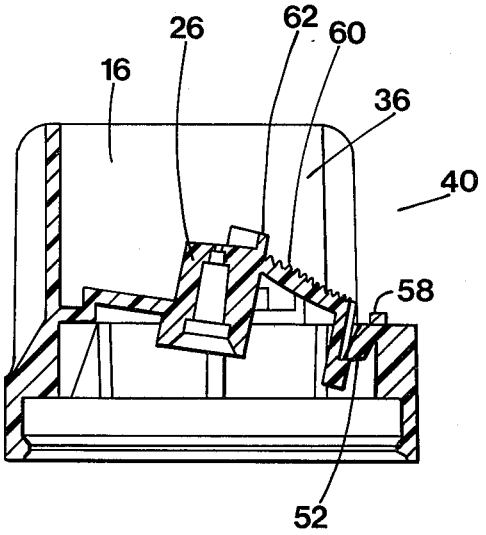
FIG. 6 is a side sectional view as in FIG. 5, but showing the dispensing device in locked actuating position.

Tab 42, before its removal, is further connected to skirt lower portion 50 by a frangible connector 58 formed on spur 52 (see FIGS. 1 and 2). This provides additional assurance of the intended child-safe and tamper-proof qualities.

Actuator button 26 includes finger press surface 60 adapted to receive finger pressure from the operator to actuate the device. Button 26 also includes a substantially sharp upwardly protruding member 62 which is centrally located on button 26 in a position to discourage or prevent attempts to depress button 26 prior to removal of tab 42. The central location of protruding member 62 and the limited space between protruding member 62 and upward extension 36 of skirt 16 makes it most difficult to find a suitable surface to receive finger pressure for depression of actuator button 26 unless tab 42 has been removed to provide additional room for a finger. Prior to removal of tab 42 considerable pressure would have to be applied to button 26 to actuate the valve, particularly since connectors 48 must be broken before button 26 can move. Protruding member 62, therefore, is an effective deterrent to actuation prior to removal of tab 42.

While in the foregoing specification this invention has been described in relation to certain preferred embodiments and many details have been set forth for purpose of illustration, it will be apparent to those skilled in the art that the invention is susceptible to additional embodiments and that certain of the details described herein can be varied considerably without departing from the basic principals of the invention.

What is claimed is:

1. A dispensing device adapted for continuous dispensing from an aerosol container of the type having a stem protruding from one end thereof, comprising:

a skirt having a lower edge adapted for attachment to such a container in positions surrounding the stem;

an actuator button hinged to the skirt and extending across the stem, said button defining a stem-engaging socket and a discharge orifice in fluid communication therewith;

said skirt extending upwardly from along a major circumferential portion of its lower edge to provide a recess for the button and defining a gap for finger access to the button; and a removable tab substantially covering the gap, said tab connected by connector means to the skirt and to the button, at least said connector means to said button being frangible.

2. A dispensing device of claim 1 wherein said connector means are along the bottom edge of the tab.

3. A dispensing device of claim 1 wherein such connector means to said skirt is frangible.

4. A dispensing device of claim 1 further including first and second interlocking means on said button and said skirt, respectively, to lock said button in a depressed dispensing position upon depression of the button after removal of the tab.

5. A dispensing device of claim 3 wherein the connector means of said tab to said skirt is a connector to the second interlocking means.

6. A dispensing device of claim 1 further including a substantially sharp upwardly protruding member centrally located on the button to discourage attempts to depress the button prior to removal of the tab.

7. A dispensing device of claim 1 wherein the device is an integrally formed unitary piece.

* * * * *